US006022652A

United States Patent [19]

Haven et al.

[11] Patent Number: 6,022,652

[45] **Date of Patent: *Feb. 8, 2000**

[54] HIGH RESOLUTION FLAT PANEL PHOSPHOR SCREEN WITH TALL BARRIERS

[75] Inventors: Duane A. Haven, Umpqua, Oreg.; Paul M. Drumm, Ventura; Robert M. Duboc, Jr., Menlo Park, both of Calif.

[73] Assignee: Candescent Technologies Corporation, San Jose, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/607,278

[22] Filed: Feb. 23, 1996

Related U.S. Application Data

[63] Continuation-in-part of application No. 08/343,803, Nov. 21, 1994, Pat. No. 5,543,683, and a continuation-in-part of application No. 08/560,166, Nov. 20, 1995.

[51] Int. Cl.[7] ..... G03C 5/00

[52] U.S. Cl. ..... 430/26; 430/25; 430/24; 427/68; 427/71; 313/496; 313/495

[58] Field of Search ..... 313/495, 496, 313/497, 472, 479, 326; 427/68, 71; 430/25, 24, 26

[56] References Cited

U.S. PATENT DOCUMENTS

| | | | |
|---|---|---|---|
| 3,814,629 | 6/1974 | Hansen et al. | 117/211 |
| 4,251,610 | 2/1981 | Haven et al. | 430/25 |
| 4,472,658 | 9/1984 | Morimoto et al. | 313/497 |
| 5,012,155 | 4/1991 | Datta et al. | 313/461 |
| 5,209,688 | 5/1993 | Nishigaki et al. | 445/24 |
| 5,316,785 | 5/1994 | Yanai et al. | 427/72 |
| 5,352,478 | 10/1994 | Miyake et al. | 427/68 |
| 5,371,433 | 12/1994 | Horne et al. | 313/495 |
| 5,378,962 | 1/1995 | Gray et al. | 313/495 |
| 5,477,105 | 12/1995 | Curtin et al. | 313/422 |
| 5,498,925 | 3/1996 | Bell et al. | 313/497 |
| 5,508,584 | 4/1996 | Tsai et al. | 313/497 |
| 5,532,548 | 7/1996 | Spindt et al. | 313/422 |
| 5,543,683 | 8/1996 | Haven et al. | 313/461 |
| 5,833,507 | 11/1998 | Woodgate et al. | 445/24 |
| 5,844,360 | 12/1998 | Jeong et al. | 313/495 |

FOREIGN PATENT DOCUMENTS

| | | | |
|---|---|---|---|
| 517000 | 9/1955 | Canada | 427/68 |
| 0 631 295 A3 | 12/1994 | European Pat. Off. | H01J 9/18 |
| 0 635 865 A1 | 1/1995 | European Pat. Off. | H01J 31/12 |
| 53-145560 | 12/1978 | Japan | 427/68 |
| 1-313840 | 12/1989 | Japan | 430/25 |
| WO 94/18694 | 8/1994 | WIPO | H01J 63/02 |
| WO 96/16429 | 5/1996 | WIPO | H01J 31/12 |

OTHER PUBLICATIONS van Oekel, J.J., "P–14: Improving the Contrast of CRTs under Low Ambient Illumination with a Graphite Coating", SID International Symposium Digest of Technical Papers, ISSN 0097–966X, Santa Ana, CA, May 1995, pp. 427–430.

*Primary Examiner*—Martin Angebranndt
*Attorney, Agent, or Firm*—Wilson Sonsini Goodrich & Rosati

[57] ABSTRACT

A method for creating a faceplate of a display provides a faceplate substrate with a faceplate interior side and a faceplate exterior side. A plurality of barriers are formed on the faceplate interior side, with the barriers defining a plurality of subpixel volumes. Phosphor containing photopolymerizable material mixtures of red, green and blue, are deposited into subpixel volumes, and create a faceplate interior side/phosphor interface. At least a portion of the phosphor containing photopolymerizable material mixture is exposed with sufficient actinic light through the faceplate interior side/phosphor interface to polymerize a selected depth of the phosphor containing photopolymerizable material mixture in the subpixel volumes, and form a polymerized phosphor containing material in a plurality of subpixel volumes. Non-polymerized phosphor containing photopolymerizable material is removed from the polymerized phosphor containing material.

16 Claims, 3 Drawing Sheets

HIGH RESOLUTION FLAT PANEL PHOSPHOR SCREEN WITH TALL BARRIERS

CROSS-REFERENCE TO RELATED APPLICATION

This application is a continuation-in-part of application Ser. No. 08/343,803, filed Nov. 21, 1994, U.S. Pat. No. 5,543,683 and a continuation-in-part of application Ser. No. 08/560,166, filed Nov. 20, 1995, pending.

This application is related to application Ser. No. 08/560, 166, filed Nov. 20, 1995, entitled "FLAT PANEL DISPLAY WITH REDUCED ELECTRON SCATTERING EFFECTS", which is incorporated by reference herein.

BACKGROUND OF THE INVENTION

1. Field of the Invention

This invention relates to a method for forming phosphors on an interior surface of a faceplate of a display, and more particularly to a method for forming phosphors on an interior surface of a faceplate with barriers defining subpixel volumes.

To optimize the image quality of these displays, it is desirable to construct physical barriers in the boundaries between the color sub-pixels to minimize optical crosstalk between subpixels. These barriers intercept electrons scattered from the phosphor in the case of FED and block diffusion of resonant photons in the case of plasma technology. In both cases, these barriers prevent loss of color purity and contrast. To function as intended, these barriers must be tall. The typical height for both FED and plasma barriers is 50 to 100 $\mu$m. This height is relatively independent of the resolution of the display so that as the resolution of the display increases, the pixel size becomes smaller and the ratio of barrier height to pixel width becomes larger.

For both FED and plasma display is it is necessary to form phosphor pixel elements of appropriate thickness and geometry in the wells created by the barriers. For full-color displays it is necessary that the white pixel be composed of adjacent RGB subpixels.

For transmissive displays of the type in which the phosphor screen is deposited on the front or viewing plate, control of the phosphor thickness, density and location is critical for optimum brightness, contrast and color-purity.

Conventional CRT displays generally incorporate a barrier of relatively planar configuration in the boundaries between phosphor subpixels to allow for positional error and to enhance viewing contrast. A common method for phosphor deposition on conventional CRT screens is by first creating a dry film of phosphor of a first color and photosensitive polymer by dispensing a wet phosphor slurry onto a spinning faceplate, drying, exposing the photosensitive film to actinic light through a shadow-mask to create a latent image of the holes in the shadow-mask, followed by developing the unexposed regions to form a phosphor pattern corresponding to the holes in the shadow mask. This process is repeated for phosphor of second and third colors to produce a full-color screen. This process is not hindered by the planar barrier, but results in reduced phosphor adhesion because the phosphor/polymer dot is exposed (and hence polymerized more fully) from the phosphor/air interface rather than from the phosphor/glass interface.

Murakami, et al., *Proc. Japan-Korea Joint Symp. Information Display*, 1992, pp. 73–78, describe methods for creation of the phosphor pixels by exposure from the glass interface to provide improved adhesion on the front glass of a plasma flat panel. This process requires a complex apparatus including a large (650 mm×900 mm) convex lens to create strictly collimated light and uses a large 1:1 photomask to expose the phosphor pattern and (planar) barrier.

Several plasma display designs in which the phosphor pixel is included in the rear plate requires a phosphor picture element geometry with phosphor covering the sides of barrier ribs for brightness efficiency and expose the address (AC plasma) or display-anode (DC plasma) electrode. These designs typically screen-print the phosphor in the deep wells. Since screen printing is an imprecise method for control of thickness and location, the phosphor screened in the wells is typically not of the desired thickness and residual phosphor remains on the tops of the barriers. Therefore, secondary processing is required to remove unwanted phosphor from the barriers and control the thickness in the wells. Sandblasting to remove phosphor is the current art. This is an intrinsically dirty process, subjecting the device to contamination by the blasting media and by the removed material.

These displays are typically "reflective" in which the emitted light from the phosphor (contained on the rear plate) is viewed through a transparent front plate.

From both FED and plasma displays, it is desirable to separate the plate containing the viewing screen (and processes) from the plate containing the emissive elements (and processes). This allows better process control and improves ultimate yield.

Current methods for creating viewing screens with phosphors are costly and difficult to scale to commercial manufacturing process. There is a need for a less expense method to form the phosphor coated viewing screen.

SUMMARY OF THE INVENTION

Accordingly, it is an object of the invention is to provide a cost effective method for creating a phosphor coated faceplate for a display.

Another object of the invention is to provide a pattemable method for creating a phosphor coated faceplate for a display.

A further object of the invention is to provide a method for creating a phosphor coated faceplate for a display that is pattemable, protects phosphor subpixels and is removable without disrupting deposited phosphor materials.

Still another object of the invention is to provide a method for creating a phosphor coated faceplate for a display in which the deposited phosphor materials are bounded by tall barriers.

Yet a further object of the invention is to provide a method for creating a phosphor coated faceplate for a display that has high brightness, contrast and color purity.

These and other objects of the invention are achieved in a method for creating a faceplate of a display provides a faceplate substrate with a faceplate interior side and a faceplate exterior side. A plurality of barriers are formed on the faceplate interior side, with the barriers defining a plurality of subpixel volumes. Phosphor containing photopolymerizable material mixtures are deposited into subpixel volumes, creating a faceplate interior side/phosphor interface. At least a portion of the phosphor containing photopolymerizable material mixture is exposed with sufficient actinic light through the faceplate interior side/phosphor interface to polymerize a selected depth of the phosphor containing photopolymerizable material mixture in the subpixel volumes, and form a polymerized phosphor containing material in a plurality of subpixel volumes. Non-polymerized phosphor containing photopolymerizable material is removed from the polymerized phosphor containing material.

DETAILED DESCRIPTION

A method for creating a faceplate of a display provides a faceplate substrate with a faceplate interior side and a faceplate exterior side. A plurality of barriers are formed on the faceplate interior side, with the barriers defining a plurality of subpixel volumes. Phosphor containing photopolymerizable material mixtures, one for red, green and blue, are deposited into subpixel volumes, creating a faceplate interior side/phosphor interface. At least a portion of the phosphor containing photopolymerizable material mixture is exposed with sufficient actinic light through the faceplate interior side/phosphor interface to polymerize a selected depth of the phosphor containing photopolymerizable material mixture in the subpixel volumes, and form a polymerized phosphor containing material in a plurality of subpixel volumes. Non-polymerized phosphor containing photopolymerizable material is removed from the polymerized phosphor containing material.

Figure 1:
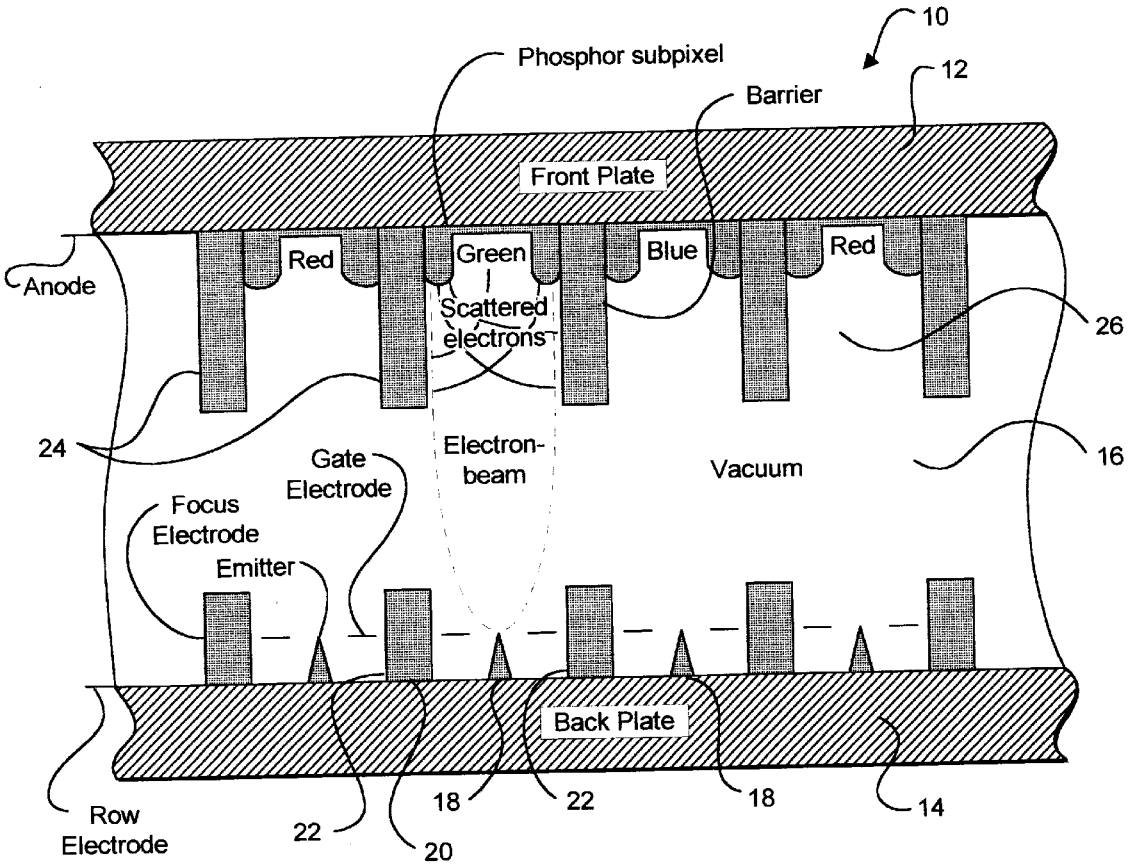
FIG. 1 is a cross-sectional view of a display envelope with tall barriers.

As shown in FIG. 1, a display 10 includes a faceplate 12 and a backplate 14 which together form a sealed envelope 16 held at vacuum pressure, e.g., approximately $1\times10^{-7}$ torr or less. One or more internal supports (not shown) support faceplate 12 against backplate 14.

A plurality of field emitters 18 are formed on a surface of backplate 14 within envelope 16. For purposes of this disclosure, field emitters 18 can include a plurality of field emitters or a single field emitter. Field emitters 18 can be filaments, cones and the like. Each field emitter 18 extends through an aperture in an insulating layer to contact an underlying emitter line. The top of each field emitter 18 is exposed through an opening in an overlying gate line. Row and column electrodes control the emission of an electron beam 20 from each field emitters 18.

Electrons defining electron beam 20 are accelerated from a plurality of field emitters 18 with energies in the range of 1 kV to 10 mkV. Electron beam 20 is focused by focus electrodes 22 to strike a corresponding polymerized phosphor containing material. There is a one-to-one correspondence between a set of field emitters 18 to a corresponding polymerized phosphor containing material defining a phosphor subpixel. Each phosphor subpixel is surrounded by a plurality of barriers 24 which define a subpixel volume 26.

Focus electrodes 22 are used in the acceleration of electrons toward a phosphor subpixel. Integrated circuit chips include driving circuitry for controlling the voltage of the row and column electrodes so that the flow of electrons to faceplate 12 is regulated. Electrically conductive traces are used to electrically connect circuitry on chips to the row and column electrodes.

Faceplate 12 and backplate 14 consist of glass that is about 1.1 mm thick. A hermetic seal of solder glass, including but not limited to Owens-Illinois CV 120, attaches side walls to faceplate 12 and backplate 14 to create sealed envelope 16. The entire display 10 must withstand a 450 degree C. sealing temperature. Within envelope 16 the pressure is typically $10^{-7}$ torr or less. This high level of vacuum is achieved by evacuating envelope 16 through a pump port at high temperature to cause absorbed gases to be removed from all internal surfaces. Envelope 16 is then sealed by a pump port patch.

Figure 2:
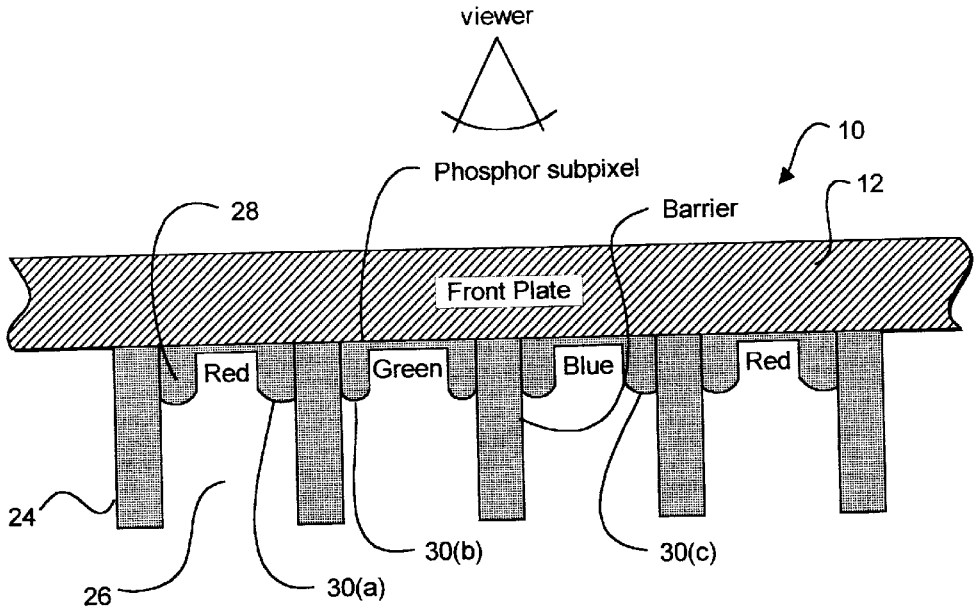
FIG. 2 is a cross-sectional view of an interior side of a faceplate with tall barriers defining subpixel volumes housing red, green or blue phosphors creating a faceplate interior side/phosphor interface.

Referring now to FIG. 2, phosphor containing photopolymerizable material mixtures (one for red, a second for green and a third for blue) are deposited into subpixel volumes 26 to create a faceplate interior side/phosphor interface 28. At least a portion of the phosphor containing photopolymerizable material mixture is exposed with sufficient actinic light through faceplate interior side/phosphor interface 28 to polymerize a selected depth of the phosphor containing photopolymerizable material mixture in subpixel volumes 26, and form a polymerized phosphor containing material 30(*a*) for red, 30(*b*) for green and 30(*b*) for blue, in separate subpixel volumes 26.

Barriers 24 are created on the interior side of faceplate 12. Barriers 24 can be made of a variety of materials including but not limited to metals, glass, ceramics, polymers, polyamides and the like. Barriers 24 may serve the function as scattering shields. The scattering shields reduce the number of scattered electrons exiting from their corresponding subpixel volumes 26. This reduces the number of scattered electrons from charging internal insulating surfaces in envelope 16, as well as the number of electrons striking non-corresponding phosphor subpixels. This increases contrast, color purity and power efficiency in the high voltage display.

The height of scattering shields is sufficient to reduce the number of scattered electrons which escape from a subpixel volume 26. Preferably, scattering shield 38 height is 12 $\mu$m, 25 $\mu$m, 25 $\mu$m. 50 $\mu$m, 75 $\mu$m, 100 $\mu$m or greater. However, the actual height and size will vary depending on dimensions of the display. Scattering shields can have heights in the range of about 20 to 200 $\mu$m, 20 to 100 $\mu$m and 50 to 100 $\mu$m beyond a height of polymerized phosphor containing material 30(*a*), 30(*b*) and 30(*c*).

Figure 3:
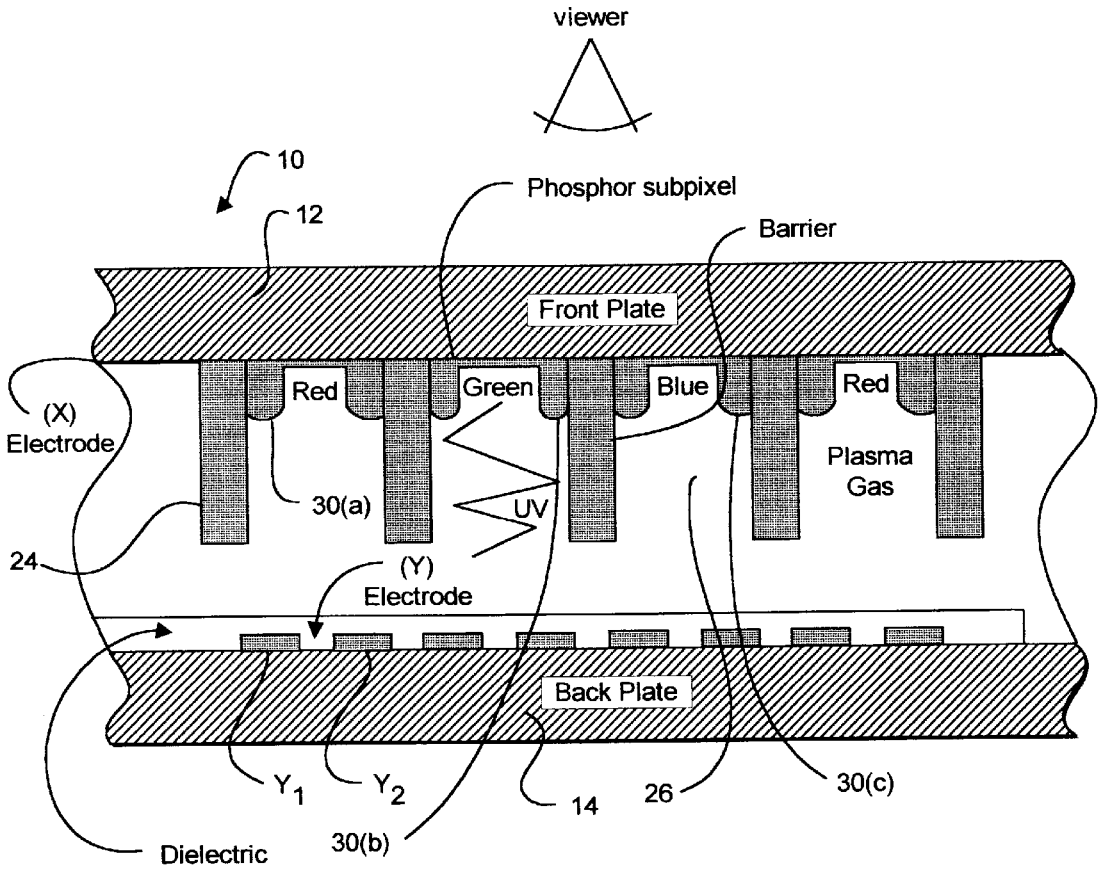
FIG. 3 is a cross-sectional view of a plasma cell.

In FIG. 3, a plasma cell is illustrated. A plasma is created between the Y electrodes to generate UV photons. X and Y electrodes are transparent and conductive. The plasma cell of FIG. 3 locks UV photons. Barriers 24 extend nearly all the way to the backplate and provide an almost closed cell with some access for vacuum evacuation.

Pluralities of red, green and blue phosphor containing photopolymerizable material mixtures are deposited into a plurality of subpixel volumes. This creates a faceplate interior side/phosphor interface. At least a portion of the phosphor containing photopolymerizable material mixture is exposed with sufficient actinic light, through the faceplate interior side/phosphor interface, to polymerize a selected depth of the phosphor containing photopolymerizable material mixture in the subpixel volumes. This forms a red, green or blue polymerized phosphor containing material in a plurality of subpixel volumes 26.

A patternable mask or a screen is utilized to form the red, green and green polymerized phosphor containing material in subpixel volumes 26. Screens and marks protect the polymerized phosphor containing materials, and the screens and masks are removable without disrupting the polymerized phosphor containing materials in their corresponding subpixel volumes 26. The use of screens and masks is a high-throughput, low-cost method of screen-printing to sequentially deposit or inject photosensitive mixtures, including but not limited to slurries, of green, then red, and then blue mixtures into the subpixel volumes 26.

The photosensitive media is then exposed to actinic light transmitted through the faceplate interior side/phosphor interface 28, thereby polymerizing the phosphor containing photopolymerizable material mixture in regions not masked by the barriers 24 surrounding each subpixel volume 26.

Unexposed phosphor containing photopolymerizable material mixture is then removed, by rinse and the like, away from tops of barriers 24 and phosphor containing photopolymerizable material mixture in the subpixel volumes 26 not penetrated by the intensity of the exposure light.

For high voltage displays 10, after unexposed phosphor containing photopolymerizable material mixture is removed, a metalization layer is formed over the red, green and blue polymerized phosphor containing material in subpixel volumes 26. The metalization layer forms a thin film, provides good morphology coverage, and has a low atomic number. Suitable metalization materials include aluminum and the like. For low voltage displays 10, a transparent conducting layer is formed on faceplate interior surface between the faceplate and the red, green and blue polymerized phosphor containing materials. A suitable conducting layer is indium tin oxide (ITO). The conducting layer reduces charge up of faceplate 12.

Figure 4A:
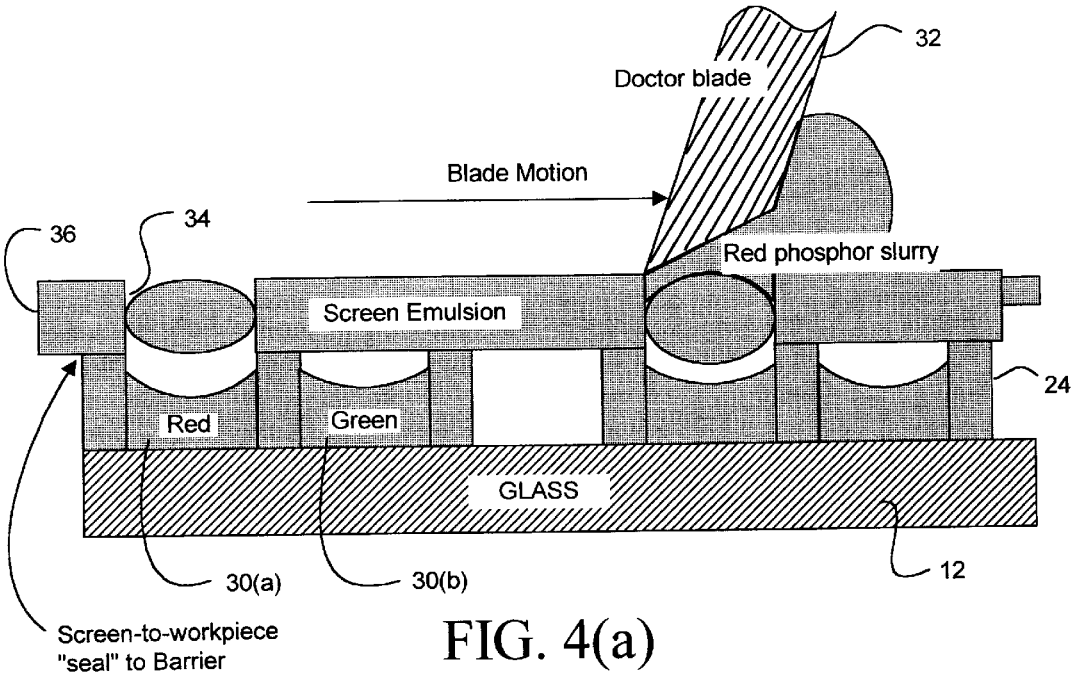
FIGS. 4(*a*) through 4(*c*) illustrate a processing sequence for fabricating a phosphor screen.
Figure 4B:
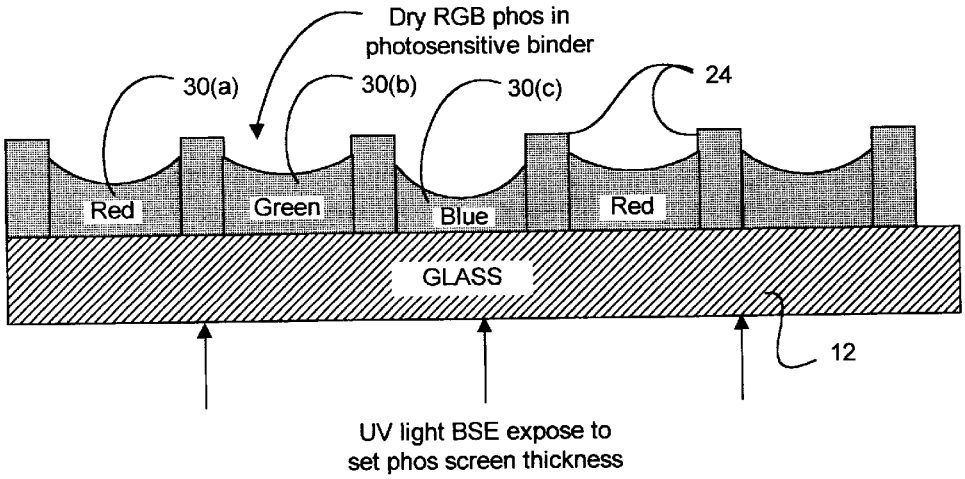
Figure 4C:
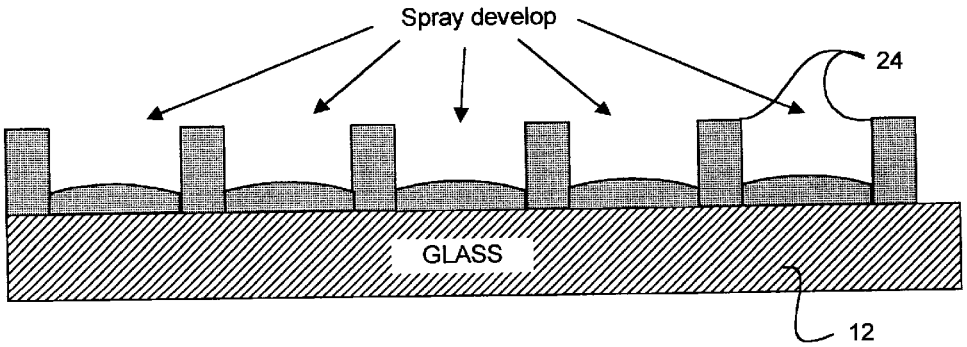

FIGS. 4(*a*) through 4(*c*), illustrate the formation of the red, green and blue polymerized phosphor containing material in subpixel volumes 26. In one embodiment, the material is a slurry of red phosphor in a photosensitive mixture of polyvinyl alcohol (PVA), water than ammonium dichromate is dispensed into subpixel volume 26 by pressure of a doctor-blade 32 forcing slurry through apertures 34 in screen 36. Slurries of green and blue phosphors are also used. It will be appreciated that the polymerized phosphor containing material need not be a slurry.

Red phosphor is then dried in a convection oven at 40° C. for 10 minutes to remove water from the photosensitive phosphor slurry.

This cycle is repeated for each additional phosphor color.

The exterior of faceplate 12, with dry photosensitive phosphor film, is then exposed to light of wavelength 365 nm for an exposure dose of 250 mJ/sq cm through the glass/phosphor interface to polymerize the PVA. The thickness of phosphor depends on exposure intensity and dose. This exposure dose provides a screen thickness of 12 $\mu$m (nom) after developing. Actinic light is blocked from the tops of barrier layer 24 so that any residual phosphor remains unexposed.

Faceplate 12 together with exposed phosphor in subpixel volumes 26 is then developed to remove unpolymerized phosphor/PVA by developing in water spray.

In one embodiment of a process for forming barriers 24, a layer of lacquer is sprayed on. The upper surface of the lacquer layer is smooth. A light reflecting layer can be evaporatively deposited on the lacquer layer. The structure is then heated at approximately 450 degrees C. for 60 minutes in a partial oxygen atmosphere to bum out the lacquer.

One selected material for barriers 24 is a photodefinable polyamide, such as OCG Probimide 7020 or other similar polymers from DuPont, Hitachi and the like.

A first layer of Probimide 7020 is deposited by conventional spin deposition at 750 RPM for 30 seconds. Faceplate 12 is then baked on a hot plate at 70 degrees C., followed by 100 degrees C. soft bake, to drive off solvents. A black matrix pattern is created by, (i) photoexposure through a mask in proximity to the Probimide layer, (ii) development of the Probimide layer, followed by (iii) baking at 450 C. The Probimide is then developed in OCG QZ3501 by a puddle/spray cycle: followed by a solvent rinse (OCG QZ 3512).

A second layer of Probimide 7020 is deposited and baked under the same conditions as the first layer. The soft baked Probimide is then photoexposed by 405 nm light through a mask in proximity to the Probimide layer. The exposed Probimide layer is then stabilized, and hard baked for 1 hour at 450 degrees C. in a nitrogen atmosphere with a thermal ramp of 3 degrees C. per minute.

Barriers 24 can also be created from black chromium and photopattemed by conventional lithography on faceplate 12.

The foregoing description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

What is claimed is:

1. A method for creating a display, comprising:

providing a faceplate substrate with a faceplate interior side and a faceplate exterior side;

applying a first layer including a first barrier material to the faceplate interior side;

removing a portion of the applied first layer;

applying a second layer including a second barrier material to the faceplate interior side after removing the portion of the applied first layer;

removing a portion of the second layer to provide a plurality of barriers at least partially formed by the first and second barrier materials on the faceplate interior side, the barriers defining a plurality of subpixel volumes such that each subpixel volume is surrounded by the barriers; and positioning phosphors in the subpixel volumes such that the height of the phosphors above the faceplate interior side is less then the height of the barriers above the faceplate interior side.

2. The method of claim 1, further comprising:

forming a metallization layer over the phosphors.

3. The method of claim 1, furter comprising:

forming a transparnt conducting layer on the interior faceplate side prior to forming the phosphors.

4. The method of claims 2 or 3, wherein the barriers form a black matrix.

5. The method of claim 2 or 3, wherein the height of the barriers surrounding a subpixel volume is sufficient to reduce the number of scattered photons from exiting from their corresponding subpixel volume to strike and charge an insulating surface in the envelope.

6. The method of claim 2 or 3, wherein the height of the barriers surrounding a subpixel volume is sufficient to reduce the number of scattered photons exiting from their corresponding subpixel volume to strike another subpixel volume.

7. The method of claim 2 or 3, wherein the height of the barriers is about 20 to 200 $\mu$m beyond the phosphor containing photopolymerizable material mixture.

8. The method of claim 2 or 3, wherein the height of the barriers is about 20 to 100 $\mu$m beyond the phosphor containing photopolymerizable material mixture.

9. The method of claim 2 or 3, wherein the phosphors have a height that extends about 1 to 30 $\mu$m from the faceplate interior side.

10. The method of claim 2 or 3, wherein the barriers have a height of about 12 $\mu$m extending beyond the phosphor containing photopolymerizable material mixture.

11. The method of claim 1, wherein the barriers are scattering shields.

12. The method of claim 1, further comprising:

photoexposing the first layer of barrier material through a mask in proximity to the first layer;

performing a soft bake to drive off solvents in the first layer;

developing the first layer a first time;

rinsing the first layer; and hard baking the first layer.

13. The method of claim 1, further comprising:

performing a soft bake to drive off solvents in the second layer;

developing the second layer.

14. The method of claim 1, wherein the first and second barrier materials are the same and include a photosensitive polyamide.

15. The method of clam 1, further comprising:

positioning the faceplate opposite a backplate.

16. The method of claim 15, wherein positioning the faceplate opposite a backplate includes aligning the subpixel volumes with field emitters included in the backplate.

* * * * *